United States Patent [19]

Jonval

[11] Patent Number: 4,659,160

[45] Date of Patent: Apr. 21, 1987

[54] ELECTRICAL CONNECTOR SOCKET SUITABLE FOR USE IN EXPLOSIVE ATOMSPHERE

[75] Inventor: Pierre Jonval, Neuilly sur Marne, France

[73] Assignee: Legrand, Limoges Cedex, France

[21] Appl. No.: 563,558

[22] Filed: Dec. 20, 1983

[30] Foreign Application Priority Data

Dec. 21, 1982 [FR] France ..... 82 21430
Jun. 14, 1983 [FR] France ..... 83 09807

[51] Int. Cl.[4] ..... H01R 13/53
[52] U.S. Cl. ..... 339/111
[58] Field of Search ..... 200/51.09; 339/111

[56] References Cited

U.S. PATENT DOCUMENTS 2,593,182 4/1952 Quackenbush ..... 173/328
3,982,812 9/1976 Boliver ..... 339/111
4,192,572 3/1980 Stanger et al. ..... 339/111
4,488,765 12/1984 Erbe ..... 339/111 X

FOREIGN PATENT DOCUMENTS 1301448 7/1962 France ..... 339/111

*Primary Examiner*—Eugene F. Desmond
*Attorney, Agent, or Firm*—Charles E. Brown; Charles A. Brown

[57] ABSTRACT

A safety connector socket suitable for use in an explosive atmosphere comprises, adapted to cooperate with the pins of a plug, at least two phase or neutral receptacles, in addition to an optional ground receptacle. It further comprises at least as many separate explosion-proof safety chambers as there are phase or neutral receptacles. Each of the phase or neutral receptacles is individually disposed in a respective one of the explosionproof safety chambers.

20 Claims, 11 Drawing Figures

ELECTRICAL CONNECTOR SOCKET SUITABLE FOR USE IN EXPLOSIVE ATOMSPHERE

BACKGROUND OF THE INVENTION

1. Field of the Invention

The present invention is generally concerned with so-called safety connectors, and is more particularly directed to safety connectors designed to be used in an explosive atmosphere.

2. Description of the Prior Art

As is known, connectors designed to connect selectively and electrically two cables, comprise, on the one hand, a female part, or socket, equipped, in addition to an optional ground receptacle, with at least two phase or neutral receptacles each connected to a respective conductor of a first of the cables and, on the other hand, a male part, or plug, equipped with pins which, connected to respective conductors of the second cable, are each designed to be engaged in a respective receptacle, to make the required electrical connection.

In an explosive atmosphere, and for obvious reasons of safety, it is important that the contact between the pins and receptacles takes place in an appropriately confined space, commonly referred to as an explosionproof safety chamber, so that if a spark is produced on such contact, either when the current is established or cut off, the explosion which may result is limited to the safety chamber, there being no propagation of the corresponding flame to the exterior of the latter.

At present, a safety chamber of this kind is common to all the receptacles of the socket.

A number of arrangements have been proposed, all of which presuppose mechanical latching of the plug to the socket.

According to a first of these arrangements, a bayonet type coupling is provided between the plug and the socket and, more often than not, there is also provided in the latter, in a separate compartment, for example, a switch which, placed on the input side of the receptacles, systematically disconnects the latter so as to permit the extraction of the plug and, inversely, to prevent its insertion when the receptacles are live.

In one variant, which is in practice permitted by the regulations only for sockets with a nominal rating below 10 A at 250 V, there is no switch of this kind but a shroud prevents direct access by the pins of the plug to the receptacles of the socket.

On insertion of the plug, rotation of it relative to the socket brings about its mechanical interlocking with the latter on the one hand and, on the other hand, either the closing of the switch utilized in the first case or the retraction of the shroud governing access to the receptacles of the socket in the second case.

In a second known arrangement, there is provided between the plug and the socket a key which governs the mechanical interlocking of the plug and the socket and which, by acting simultaneously on a switch situated in a separate compartment of the latter, closes or opens the connection on the input side of the receptacles.

In practice, arrangements of this kind result in relatively complex assemblies requiring a switch or shroud combined with a mechanical locking device, and are therefore relatively bulky and expensive.

A general objective of the present invention is an arrangement whereby these disadvantages can be overcome and in particular providing for automatic disconnection of the receptacles of the socket on removal of the plug without utilizing any form of switch or any form of shroud, and with no mechanical locking device.

SUMMARY OF THE INVENTION

The invention consists in a safety connector socket, suitable for use in an explosive atmosphere, of the kind comprising, in a body of an insulative material, adapted to cooperate with the pins of a plug, in addition to an optional ground receptacle, at least two phase or neutral receptacles, and at least as many separate explosionproof safety chambers as there are phase or neutral receptacles, each of said phase or neutral receptacles being individually disposed in a respective one of said explosionproof safety chambers.

Thus and with advantage it is possible to treat individually each of the pin-receptacle combinations concerned.

In practice, to this end and in accordance with the invention, within each explosionproof safety chamber corresponding to a pin-receptacle combination of this kind there are disposed, on the one hand, on the back of this safety chamber, a contact member and, on the other hand, axially movable within said chamber, a contact piston which divides the latter into two parts and which, at the front, on the same side as its outlet, carries the associated receptacle.

For example, the contact member thus utilized in an explosionproof safety chamber is itself a pin, referred to hereinafter for convenience as a socket pin, in order to distinguish it from the pins of the plug, this socket pin projecting axially from the back of the explosionproof safety chamber it equips, and the corresponding contact piston has at the rear, on the same side as said back, a receptacle by virtue of which it is adapted to cooperate with said socket pin.

Alternatively, this contact member is a stud projecting axially from the back of the explosionproof safety chamber it equips and the corresponding contact piston is telescopic, that is formed in at least two parts which are axially movable relative to one another against the action of elastic means adapted to urge them apart, in opposite axial directions, the piston part at the front carrying the associated receptacle and that at the rear being adapted to cooperate with said stud, by virtue of simple bearing engagement therewith.

Be this as it may, the stroke of the contact piston within the explosionproof safety chamber is sufficient for there to be no contact between it and the associated contact member when it is at the forward end of its stroke, on the same side as the outlet from said chamber.

Consequently when the plug is withdrawn from the sockets, its pins entrain the contact pistons with the front receptacles of which they are respectively engaged and, before they become themselves disengaged from these contact pistons, they bring about, by virtue only of their own retraction movement, disengagement of these contact pistons from the associated contact members.

In other words, the removal of a plug from a socket in accordance with the invention offers the advantage of a double disconnection, that is, on the one hand, disconnection of the contact pistons from the contact members present in the corresponding explosionproof safety chambers and, on the other hand, disconnection of the plug pins from the contact pistons.

Thus the applicable safety conditions are adhered to in a very simple manner.

Other things being equal, the socket is itself and with advantage simplified and its dimensions are reduced.

Also, no special device such as a bayonet coupling or key is required and the pins of the plug may be simple pins set out in a standardized arrangement and thus conforming to the dimensions for interchangeability set out in the official standards concerned.

Other objects and advantages will appear from the following description of an example of the invention, when considered in connection with the accompanying drawings, and the novel features will be particularly pointed out in the appended claims.

DESCRIPTION OF THE PREFERRED EMBODIMENT

Figure 1:
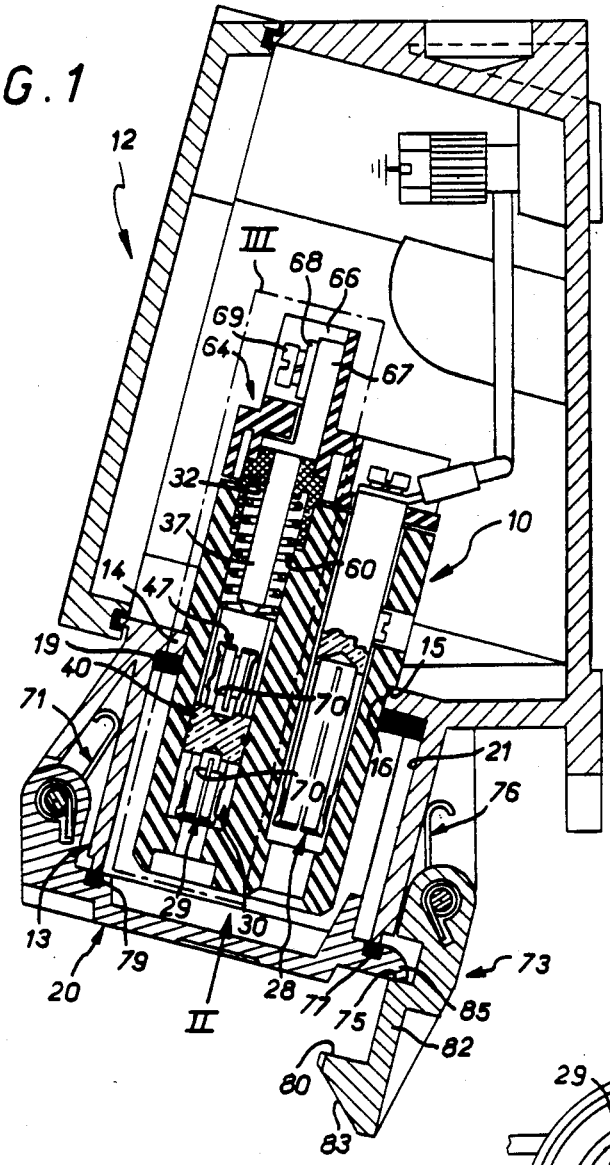
FIG. 1 is a view in cross-section on the broken line I—I in FIG. 2 of a safety connector socket in accordance with the invention.
Figure 2:
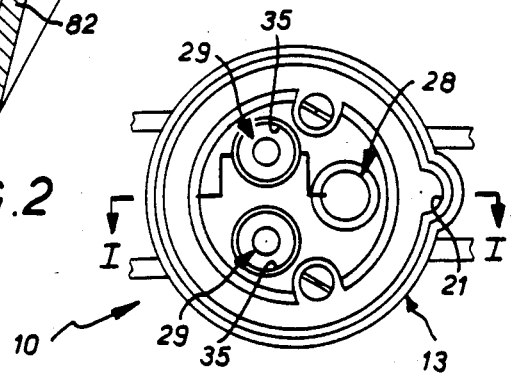
FIG. 2 is a partial view in elevation of this socket, in the direction of the arrow II in FIG. 1.

As shown in these figures, the safety connector with which the present invention is concerned comprises, in the usual manner, a female part 10 or socket and a male part 11 or plug.

In the embodiments shown, the socket 10 is carried by a housing 12 of the so-called "enhanced safety" type, through the intermediary of which it may be attached to any form of support.

A housing 12 of this kind being well known in itself and not forming part of the present invention, it will not be described in detail here.

It is sufficient to indicate that, for the purposes of installing the socket 10, it comprises a well 13 to the back 14 of which the socket 10 is attached in some appropriate manner, bearing on it through a transversely projecting shoulder 15 or flange 15' with which it is provided for this purpose, whilst passing through the central opening 16 in the back 14 leaving between itself and the side wall of said well 13 an annular space adapted for insertion of the skirt 18 of the plug 11, that at the back of said well 13 there is placed a sealing gasket 19 constituting a bearing surface for the edge of said skirt 18 of the plug 11, and that a cover 20 is pivoted to the outside wall of the well 13 and is adapted to close and seal it in the absence of any plug 11.

In practice, in the embodiments shown and in a manner known in itself, the cover 20, which is urged towards its closed position 20 by a spring 71, is intended to be applied over the outlet from the well 13 and, for the purposes of the required sealing, it carries an annular gasket 79 in a groove 77.

Also, in the embodiments shown and in a manner also known in itself, the side wall of the well 13 is locally formed with a longitudinal groove 21 adapted to constitute a polarizer, the skirt 18 of the plug 11 featuring a corresponding rib 22 complementary with this groove over at least part of its height from its edge.

Figure 5C:
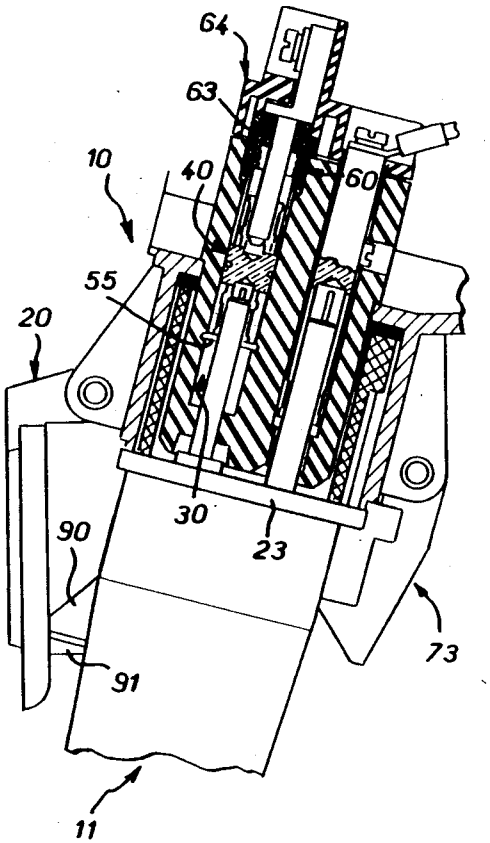
FIGS. 5A, 5B, 5C are partial views to a different scale analogous to that of FIG. 1 and illustrating various phases in the utilization of the safety connector socket in accordance with the invention.
Figure 5B:
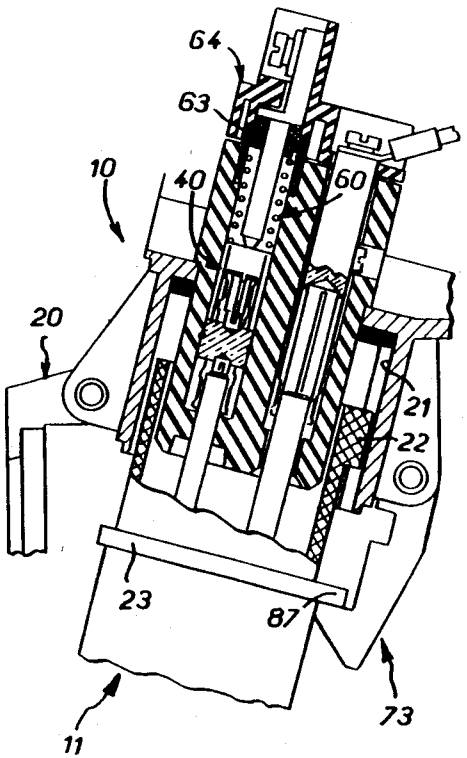
Figure 5A:
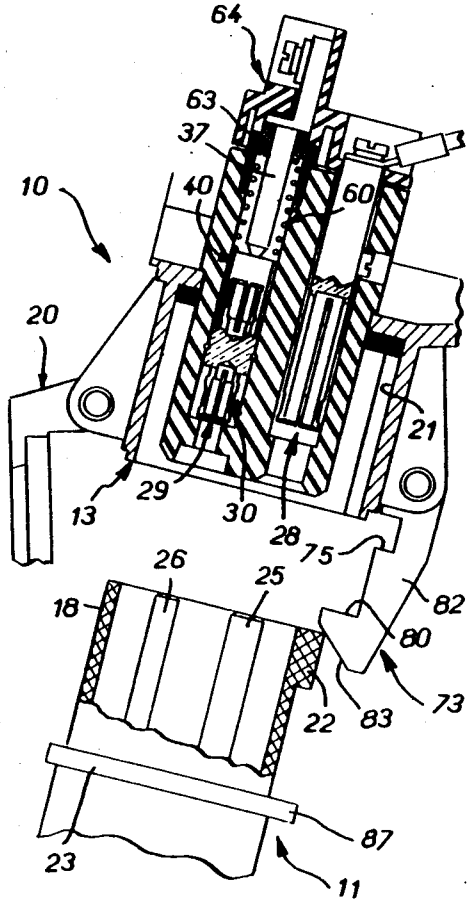

The plug 11, which is shown only partially in the figures and, in practice, only in FIGS. 5A, 5B, 5C, does not constitute part of the present invention either and, being well known to those skilled in this art, will not be described in detail here.

It is sufficient to specify that, externally, its skirt 18 has a transversely projecting flange 23 adapted to bear on the edge of the well 13 of the housing 12 and that, internally and projecting from a base not visible in the figures, it comprises, in addition to an optional ground pin 25, as shown, at least two phase or neutral pins 26.

In practice, in the embodiment shown and in order to simplify the figures, only two pins 26 have been shown. These are phase pins, it being assumed that the connector concerned is for a single-phase system.

In a manner known in itself, the socket 10 forms a body of insulating material and, for the purpose of cooperation with the pins of the plug 11, it comprises, in addition to an optional ground receptacle 28, as shown, at least two phase or neutral receptacles 29.

As indicated above, only two receptacles 29 are provided, and these are phase receptacles.

In accordance with the invention, the socket 10 comprises at least as many separate explosionproof safety chambers 30 as there are phase or neutral receptacles 29, each of the phase or neutral receptacles 29 being individually disposed in a respective one of said explosionproof safety chambers 30.

In practice, in the embodiment shown, the number of explosionproof safety chambers 30 utilized is equal to the number of phase or neutral receptacles 29, no explosionproof safety chamber being provided for the ground receptacle 28.

A ground receptacle 28 of this kind does not normally itself require an explosionproof safety chamber of this kind.

However, it will be well understood that the scope of the present invention would not be exceeded if this ground receptacle 29 were treated in the same way as the phase or neutral receptacles 29.

At the inner or rear end of the socket 10 each of the explosionproof safety chambers 30 is individually closed off, in the embodiments shown in FIGS. 1 to 7 and 9, by a plug 63 of insulative material which forms the back 32 of the explosionproof safety chamber 30.

The axial length L over which a plug 63 of this kind is engaged within an explosionproof safety chamber 30, which corresponds to a leakage line, is sufficient to meet the constraints which apply in this connection.

In the embodiments shown in FIGS. 1 to 7 and 9 the set of plugs 63 thus provided is covered by a common external cap 64 which, externally, comprises as many receptacles 66 as there are phase or neutral receptacles 29, and within each of these there extends a contact part 67.

Within the corresponding receptacle 66 there is associated with a contact part 67 of this kind, for the purpose of its electrical connection to an electrical conductor, not shown, a stirrup member 68 adapted to clamp the electrical conductor against said contact part 67 by means of a screw 69.

At the outside or front end the socket 10 comprises, for each explosionproof safety chamber 30, a collar 34 which extends transversely within the explosionproof safety chamber 30 and the opening 35 in which defines the outlet to the exterior of the latter.

It will be understood that diameter D of this opening 35 corresponds to that ofo the pins 26 of the plug 11.

It will also be understood that the axial length L' of the collar 34, which also defines a leakage line, is at least equal to the axial length L specified hereinabove, in order to comply with applicable standards, and may be equal to the latter, for example.

It is by virtue of arrangements of this kind that a safety chamber 30 of this sort constitutes an explosionproof safety chamber.

In an explosionproof safety chamber 30 thus constituted there are disposed, in accordance with the invention, on the one hand a contact member on the back 32 of the explosionproof safety chamber 30 and, on the other hand, axially movable within the latter, a contact piston 40 which divides said explosionproof safety chamber 30 into two parts and which, at the front, on the same side as the outlet 35 from the latter, carries the associated phase or neutral receptacle 29.

In the embodiments specifically shown in FIGS. 1 to 8, the contact member on the back of each explosionproof safety chamber 30 is a pin 37, hereinafter referred to for convenience as the socket pin.

In practice, this socket pin 37, which is of metal, projects axially from the back 32 of the explosionproof safety chamber 30 which it equips, and, passing through the corresponding plug 63 by means of an axial bore 43 in the latter whose axial length L'' is preferably, for the same reasons are previously, at least equal to the axial length L specified hereinabove, is integral with the associated contact part 67.

Conjointly, for the purposes of cooperation with the corresponding socket pin 37, the contact piston 40 has, in the embodiments shown in FIGS. 1 to 8, at the rear, on the same side as the back 32 of the explosionproof chamber 30 in which it is slidably mounted, a rear receptacle 47 by virtue of which it is adapted to cooperate with said socket pin 37.

In practice, a contact piston 40 of this kind, which is of metal, thus features, in the embodiments shown in FIGS. 1 to 8, disposed back to back one on each side of a common median base 48 by means of which it is slidably engaged in the explosionproof safety chamber 30 which it equips, on the one hand, in the direction towards the outlet 35 from the latter, the corresponding phase or neutral receptacle 29 and, on the other hand, in the direction towards its back 32, the receptacle 47.

Also, in these embodiments, at least one of the receptacles 29, 47 of each contact piston 40 has internally and spaced from its back a transverse shoulder 70 adapted to limit its engagement on the corresponding plug or socket pin; for preference and as shown this applies to both the latter.

In practice, and in a manner known in itself, each of these receptacles 29, 47 is circumferentially subdivided by slots 50 so as to have a certain degree of radial elasticity and thus to elastically grip the corresponding pin 26, 37 when engaged with the latter.

For preference, for the purposes of such gripping, each of the receptacles 29, 47 is elastically prestressed in the radial direction towards the corresponding pin 26, 37.

For example, and in a manner known in itself, this prestressing is obtained by means of a binding ring 51 forming a spring which extends annularly around the outside of a receptacle 29, 47 of this kind.

In practice, in the embodiment shown, the receptacles 29, 47 are generally of the same axial length and of the same design.

Figure 3:
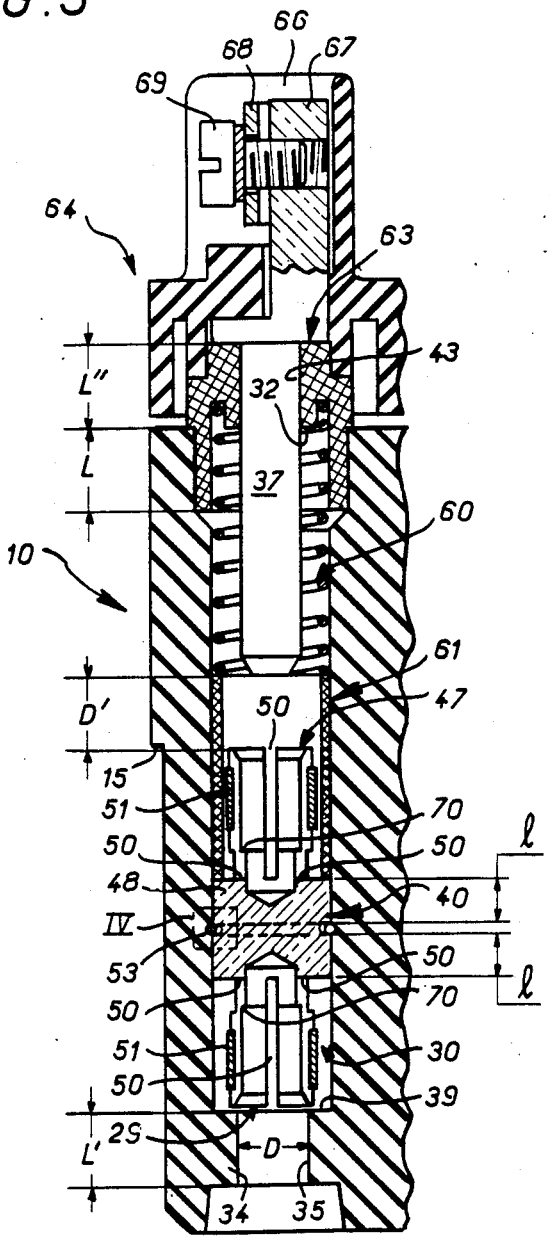
FIG. 3 shows to a larger scale the detail of FIG. 1 indicated by the box III thereon.

Also in practice, the stroke of the contact piston 40 in the explosionproof safety chamber 30 which it equips is sufficient for there to be no contact between it and the socket pin 37 forming the associated contact member when it is at the forward end of its stroke, on the same side as the outlet 35 from said explosionproof safety chamber 30, as shown in FIG. 3.

For preference, it is then separated from the latter by a distance D' which, corresponding to a distance in air after unplugging, is sufficient to conform to applicable standards.

Also for preference, and as shown, there are associated with a contact piston of this kind, in the embodiments shown in FIGS. 1 to 8, disengageable snap-fastener means adapted to retain it in position at the forward end of its stroke.

In the embodiment shown, the disengageable snap-fastener means comprise, on the one hand, an elastic ring 53, a split elastic ring, for example, which is engaged in an annular groove 54 provided for this purpose on the external periphery of the contact piston 40, in the central part of the median base 48 of the latter, and a complementary annular groove 55 provided on the internal wall of the corresponding explosionproof safety chamber 30, for engagement with said elastic ring 53.

For preference, the distance 1 separating the flanks of the groove 54 of the contact piston 40 from the corresponding free surface of the median base 48 of the latter in the axial direction is at least equal to half the axial length L specified hereinabove.

By virtue of these snap-fastener means, and as better shown in FIG. 3, when in this forward end of stroke position the contact piston 40 is not in axial abutting relationship with the collar 34 defining the outlet 35 from the explosionproof safety chamber 30 concerned, but is rather slightly spaced from the internal surface 39 of the latter.

In the embodiments shown in FIGS. 1 to 7 and 9 each of the contact pistons 40 is subjected to the action of elastic return means which continuously urge it towards its forward end of stroke position, that is to say in the direction towards the outlet 35 from the explosionproof safety chamber 30 in which it is movably disposed.

In practice, in these embodiments, these elastic return means consist of a metal helical coil spring 60 which acts through an intermediate member 61 of an insulative material on the contact piston 40 with which it is associated.

In the embodiments concerned, the intermediate member 61 forms a bush which, bearing on the median base 48 of the contact piston 40, extends annularly around its rear receptacle 47 and, in practice and as shown, beyond the free edge of the latter.

Conjointly, the spring 60 which extends annularly around the corresponding socket pin 37 itself bears on the plug 63 forming the back 32 of the explosionproof safety chamber 30 concerned.

Finally, in the embodiments shown, there is pivoted to the housing 12 of the socket 10, in addition to the cover 20, a latch member 73 which is adapted by means of a notch 75 to maintain the cover 20 in the closed position and which is itself urged in the direction towards the corresponding position by a spring 76.

In accordance with the invention, the latch member 73 has, beyond the first-mentioned notch, a second notch 80 by means of which it is adapted, as will emerge hereinafter, to retain the associated plug 11 at least temporarily in an intermediate position during the extraction thereof.

In practice and as shown, this second notch 80 is formed on an extension 82 of the latch member 73 and is preceded by an oblique engagement chamfer 83.

In the embodiments shown, the pivot axes of the cover 20 and the latch member 73 are in diametrically opposed positions relative to the well 13 and, for the purposes of co-operation with the notch 75 of the latch member 73, the cover 20 has a peripheral and radially projecting tab 85.

Likewise, for the purposes of co-operation with the notch 80 of the latch member 73, the skirt 18 of the plug 11 has a radially projecting tab 87 on the flange 23 which it usually incorporates for its bearing engagement on the outlet from the well 13 of the socket 10.

In the ready position, the cover 20 is closed and the contact pistons 40 are in the forward end of stroke position, the elastic ring 53 each carries being engaged in the groove 55 in the corresponding explosionproof safety chamber 30, as shown in FIGS. 1, 3 and 5A.

Thus they are not live, and the corresponding socket pins 37, which are live, are inaccessible.

The plug 11 is inserted in two stages.

In a first stage, the cover 20 is opened by momentarily moving back the latch member 73, the plug 11 is offered up in line with the well 13 (FIG. 5A), and after temporary retraction of the latch member 73 by pressure on its engagement chamfer 83, initially by the edge of the skirt 18 (FIG. 5A) and then by the flange 23, it is inserted into the well 13 with its pins 26 entering the phase or neutral receptacles 29 of the contact pistons 40 (FIG. 5B), to the point of abutting relationship against the transverse shoulder 70 of the latter and entry of the ground pin 25 into the ground receptacle 28.

By virtue, on the one hand, of their snap-fastener retention in the forward end of stroke position by the elastic ring 53 which each carries and, on the other hand, due to the force applied by the spring 60 with which each is associated, the contact pistons 40 remain temporarily in their forward end of stroke position, in spite of the entrainment force to which they are subjected, because of friction, on the entry of the pins 26 of the plug 11.

The design is such that the axial force with which the force receptacle 29 of a contact piston 40 opposes the insertion of a plug pin 26, by virtue of its radial prestressing, is lesser than the sum of the axial force required to disengage the disengageable snap-fastener means formed by the elastic ring 53 carried by the contact piston, on the one hand, and the axial force necessary to overcome the action of the associated spring 60, on the other hand; it is therefore the front receptacle 29 which is the first to yield elastically on such insertion.

Thus the connection of the pins 26 of the plug 11 with the contact pistons 40 in accordance with the invention occurs, with advantage, when the latter are not live.

In a second stage, insertion of the plug 11 into the well 13 of the socket 10 continuing, the pins 26 of the plug, bearing on the corresponding transverse shoulder 70 of each contact piston 40, entrain the latter in the direction towards the socket pins 37, the elastic ring 53 each carries yielding elastically and taking up a retracted position in contact with the internal wall of the corresponding explosionproof safety chamber 30, and thus constrain the contact pistons 40 to become engaged by virtue of their rear receptacle 47 on said pins 26 (FIG. 5C).

Conjointly, the springs 60 associated with the contact pistons 40 are compressed.

The contact pistons 40 being thus engaged with the pins 26 of the plug 11 on the one hand and with the socket pins 37 on the other hand, they establish electrical contact between these pins 26 and the pins 37, as required.

In the usual manner, the plug 11 is then locked in the inserted position by a tab 90 which projects laterally from it to this end and with which cooperates for purposes of retention with a tab 91 of the cover 20.

The plug 11 is also removed in two stages.

In a first stage, with a traction force applied to the plug 11, removal of the latter is limited by abutment of the tab 87 of the flange 23 of its skirt 18 against the notch 80 of the latch member 73, as shown in FIG. 5B.

However, by virtue of the entrainment force to which they are subjected by the pins 26 of the plug 11 on the one hand and the axial return force to which they are subjected by the springs 60 associated with them on the other hand, the contact pistons 40 follow the plug 11 as it is withdrawn.

The design is such that the axial return force of which a spring 60 of this kind is capable is, in accordance with the invention, preferably greater than the axial force due to friction between the elastic ring 53 carried by each of the contact pistons 40 and the internal wall of the explosionproof safety chamber 30 concerned.

To counterbalance this, the radial prestressing to which the receptacles 29, 47 of a contact piston of this kind are subjected by virtue of the binding ring 51 which surrounds them can with advantage be the same for both receptacles 29, 47 and the corresponding binding rings 51 may thus be identical.

In practice, the arrangement is such that in the intermediate position of the plug 11 due to the notch 80 of the latch member 73, the contact pistons 40 are themselves in the forward end of stroke position, the elastic ring 53 which each carries being again engaged in the groove 55 in the corresponding explosionproof safety chamber 30, having resumed its initial deployed position by virtue of its inherent elasticity.

Thus in this intermediate position of the plug 11, representing the end of the first stage of its extraction, the contact pistons 40 are unplugged from the socket pins 37 and, these contact pistons 40 thus not being live, the same applies to the pins 26 of the plug 11 with which they are still engaged.

Thus it is possible, with advantage, to leave the plug 11 in the socket 10, if required, whilst ensuring that it is unplugged, which overcomes in a very simple manner the ongoing problem of taking the plug 11 out of service, under conditions of safety, especially when this need only be temporary.

In a second stage, if required, extraction of the plug 11 may continue by retracting the latch member 73.

Its pins 26 then disengage from the contact pistons 40, whereas the latter remain in the forward end of stroke position which they already occupy.

However, in accordance with the invention, the corresponding disconnection occurs, with advantage, when the contact pistons 40 are no longer live.

As a corollary to this, by virtue of the force applied by the spring 71, the cover 20 closes and, its tab 85 engaging with the notch 75 of the latch member 73, it is held in the closed position by the latter.

Be this as it may, when the plug 11 must be removed completely, the latch member 73 in accordance with the invention offers the advantage of dividing such removal into two stages, on the one hand to move said plug 11 from its plugged in position to its intermediate position, in which, as explained hereinabove, it is already unplugged, and, on the other hand, for its subsequent complete removal.

Such subdivision of the removal into two stages offers the advantage of overcoming possible consequences of excessively rapid removal which, especially when the currents to be interrupted are highly inductive, can cause the plug 11 to be tracked by an unwanted and hazardous arc which is struck when it is unplugged.

In all cases, because of the return spring 60 associated with them and of the elastic ring 53 which retains them in their forward end of stroke position, the contact pistons 40 are, with advantage, never live when the plug 11 is removed.

Subsequently, insertion of the plug pins 26 into the contact pistons 40 definitely takes place when the latter are not live, with no contact with the associated socket pins 37.

Moreover, no misoperation is possible if, for example, during insertion of the plug 11 into the socket 10, the plug 11 is prematurely withdrawn before insertion has terminated normally.

In this case, the contact pistons 40 are necessarily brought into their forward end of stroke position by the pins 26 of the plug 11 with which they are necessarily engaged, without any risk of them being left in an intermediate position, in which they might be in contact with the corresponding socket pins 37 and therefore live.

Also, and as will have been understood, the internal shoulder 70 featured by each of the receptacles 29, 47 of the contact pistons 40, in the embodiments shown in FIGS. 1 to 7 and 9, offers the advantage of minimizing the corresponding movement for engagement on the pins 26, 37 whilst enabling said receptacles 29, 47 to be of whatever length is required to achieve the necessary elasticity.

Figure 7:
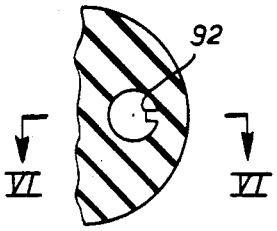
FIG. 7 is a view in transverse cross-section on the line VII—VII in FIG. 6.
Figure 6:
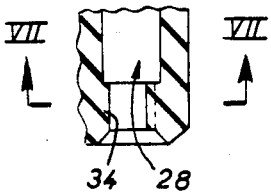
FIG. 6 is a partial view in cross-section on the line VI—VI in FIG. 7, also to a different scale, of a variant of the aforementioned safety connector socket.
Figure 4:
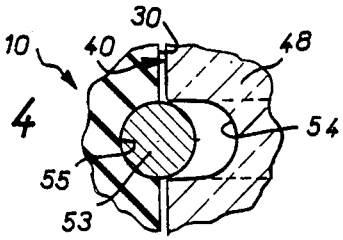
FIG. 4 shows to a large scale the detail of FIG. 3 shown by the box IV thereon.

As shown in FIGS. 6 and 7, a polarizing device may be provided to prevent the insertion of a plug 11 which does not meet any applicable safety standards.

In this case there is provided a radially projecting rib 92 on the collar 34 of the ground receptacle 28 and a complementary groove on the corresponding ground pin 25 of the plug 11.

Figure 8:
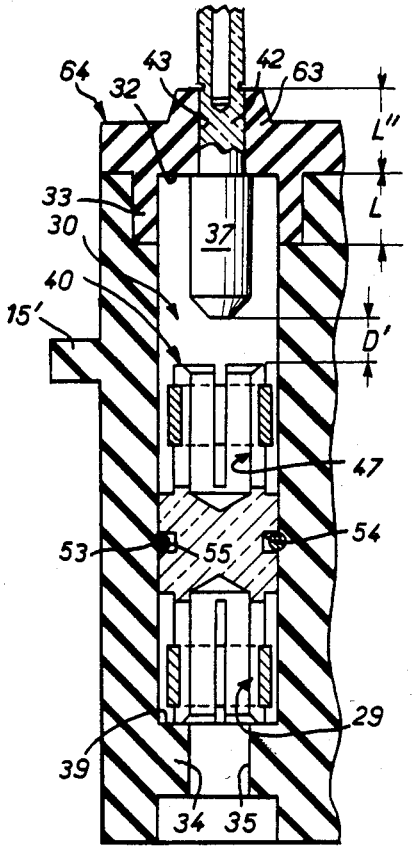
FIGS. 8 and 9 are detailed views analogous to those of FIG. 3 and relating to respective other embodiments of the safety connector socket in accordance with the invention.

In the embodiment shown in FIG. 8, there is no spring urging the contact pistons 40 in the direction towards their forward end of stroke position.

However, the design is such that by appropriate selection of the characteristics of the various component parts in question, the radial prestressing towards the corresponding pins 26, 37 to which the front receptacle 29 of each contact piston 40 is subjected is greater than that of its rear receptacle 47.

Conjointly, the design is also such that the axial force due to the gripping of a plug pin 26 by a front receptacle 29 of the contact piston 40 due to the radial prestressing of the receptacle is greater than the sum of the axial force due to the gripping of the corresponding socket pin 37 by the receptacle 47 due to the radial prestressing of the rear receptacle 47, on the one hand, and the axial force due to friction between the elastic ring 53 carried by the contact piston 40 and the internal wall of the explosionproof safety chamber 30, on the other hand.

Subsequently, when a plug 11 inserted in the socket 10 is withdrawn, there results firstly, as previously, entrainment of each of the contact pistons 40 of the socket 10 by the pins 26 of the plug 11 and then, during a second stage, disengagement of the pins 26 from the contact pistons 40.

In the embodiment shown, each of the contact pistons 40 is then in abutting relationship with the internal surface 39 of the collar 34 forming the outlet 35 from the corresponding explosionproof safety chamber 30.

However, it will be well understood that it could still be at a slight distance from this surface, as previously, its forward end of stroke position being then defined by the elastic ring 53 which it carries when the latter is engaged in the groove 55 in the explosionproof safety chamber 30.

Inversely, when a plug 11 is inserted in the socket 10 there results, firstly and as previously, engagement of the pins 26 of the plug 11 in the front receptacles 29 of the contact pistons 40, without the latter being entrained.

The design is such that in this case the axial force which a forward receptacle 29 of a contact piston 40 opposes to the engagement of a plug pin 26, by virtue of its radial prestressing, is less than the axial force necessary to disengage the disengageable snap-fastener means associated with the contact pistons 40.

It is thus this front receptacle 29 which, as previously, is the first to yield elastically.

In a second stage when, in the embodiment shown, the pins 26 of the plug 11 have reached the ends of the front receptacles 29 of the contact pistons 40, insertion of the plug 11 into the socket 10 continues, the axial force necessary to disengage the disengageable snap-fastener means associated with the contact pistons 40 is in turn overcome and the contact pistons 40 are then entrained by the plug 11.

During this movement, the contact pistons 40 are in turn engaged, by virtue of their rear receptacle 47, on the socket pins 37.

Also, in this embodiment, the corresponding rearward end of stroke position of the contact pistons 40 is defined by the back 32 of the explosionproof safety chamber 30 in which they are movably mounted.

In practice, in this embodiment, the plug 63 of this chamber is integral with the associated cap 64, which itself features the bore 43 required for the passage of an extension 42 of the associated socket pin 37, around an annular upstand 33 adapted for local engagement with the explosionproof safety chamber 30 concerned, and the extension 42 of the socket pin 37 is tubular, for crimping onto the conductive core of an electrical conductor.

Figure 9:
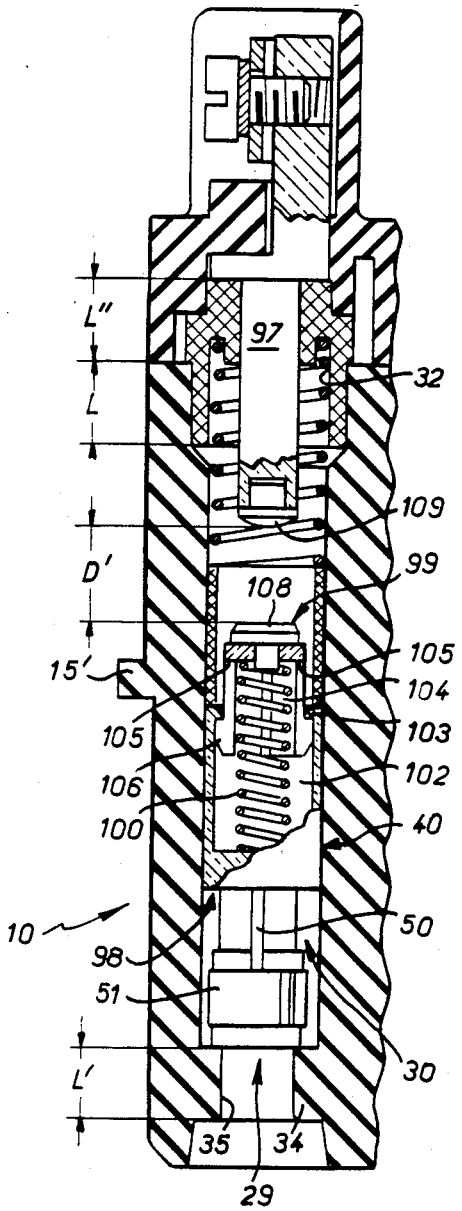

In the embodiment shown in FIG. 9, the contact member on the back 32 of each explosionproof safety chamber 30 is a stud 97 which, like the aforementioned pin 37, projects from the back 32, and the contact piston 40 which, in accordance with the invention, is movably mounted within the explosionproof safety chamber 30 is a telescopic piston, that is to say formed by at least two piston parts 98, 99 which are axially movable relative to one another.

In practice, in this embodiment, only two pistons parts 98 and 99 are provided, and elastic means in the form of a spring 100 urge them apart, that is in opposite axial directions.

The piston part 98, which is that at the front, on the same side as the outlet 35 from the corresponding explosionproof safety chamber 30, carries the associated phase or neutral receptacle 29 with, as previously, slots 50 and a binding ring 51, whereas the piston part 99, which is thus that disposed at the rear, on the opposite side from the outlet 35, is adapted to cooperate with the stud 97, by simple bearing engagement therewith.

In the embodiment shown, the piston part 98 is formed with a rear receptacle 102 within which is engaged the piston part 99, and the outlet from which is bordered by a transverse rim 103 directed towards its axis.

The piston part 99 itself forms a receptacle 104 by virtue of which it is engaged in the receptacle 102 of the piston part 98 and the lateral wall of which is circumferentially subdivided by slots 105 with, externally, projecting from the end of the lateral wall, in the direction opposite its axis, a transverse rim 106 adapted to engage with the rim 103 of the piston part 98, to retain it in relation to the latter.

The spring 100 is accommodated in the space defined by the two receptacles 102, 104, bearing on the back of each.

Externally, for the purposes of cooperation with the stud 97, the piston part 99 has a contact pad 108 and, for cooperating with this, the stud 97 carries a contact pad 109.

The contact pads 108, 109 are for preference of a metal or alloy selected for its high conductivity.

In the embodiment shown, the stud 97 is of similar length to the aforementioned pin 37.

Alternatively, it could be of limited length, just sufficient for the contact pad 109 which it carries to project from the back 32 of the explosionproof safety chamber 30 concerned.

Otherwise, the embodiment shown in FIG. 9 is of the same kind as that shown in FIGS. 1 to 5 with, in particular, the individual plug 63, the spring 60 and the intermediate member 61.

Be this as it may, the sample bearing contact developed between the contact piston 40 and the pad 97 in this embodiment provides for avoiding possible binding between these parts when the current and/or voltage are high, which is favorable to the break capacity of the combination.

It will be understood that various changes in the details, materials and arrangements of parts, which have been herein described and illustrated in order to explain the nature of the invention, may be made by those skilled in the art within the principle and scope of the invention as expressed in the appended claims.

In particular, in the case where the contact pistons each have two receptacles and these are differently radially prestressed, the socket pins may, to this end, be of slightly smaller diameter than the plug pins.

An arrangement of this kind offers the advantage of permitting a symmetrical contact piston to be used, simplifying manufacture and assembly.

Also, the well in which there is disposed the barrel member comprising the phase or neutral receptacles of the socket may constitute a part separate from the housing of the socket and appropriately attached to the latter, by screws for example, by clamping a flange with flats provided for this purpose projecting radially from the barrel member. This provides for, in particular, orienting the barrel member in a particular angular position by rotation about its axis, according to the intended operating voltages, whilst ensuring appropriate retention in the axial direction without further fixing means.

Moreover, the scope of application of the invention is not limited to the case where two phase receptacles are used, as in a single-phase installation.

To the contrary, it extends equally well to three-phase installations in which three phase receptacles are used, possibly with a neutral receptacle, in addition to an optional ground receptacle.

I claim:

1. A safety connector socket for use with a plug in an explosive environment, said socket comprising at least two phase or neutral receptacles and an optional ground receptacle, means defining fixed explosionproof safety chambers for each of said phase or neutral receptacles, a contact member mounted at the back of each of said safety chambers, a contact piston mounted for movement in each of said chambers and dividing each of the respective chambers into two, front and back, compartments, said phase or neutral receptacles being carried by said contact pistons in the front compartment of the respective chambers, said contact pistons having a first position for entering into contact with plug pins when said receptacles are out of electrical contact with their respective contact members and a second position in which said receptacles are electrically connected to their respective contact members, said contact pistons being responsive to insertion of plug pins for their displacement in said fixed chambers from said first position to said second position.

2. A socket according to claim 1, wherein each said contact member comprises a socket pin axially projecting from the back of its explosionproof safety chamber, and each said contact piston carries in its back compartment another, rear, receptacle cooperable with the associated socket pin.

3. A socket according to claim 1, wherein each said contact member comprises a stud axially projecting from the back of its explosionproof safety chamber, each said contact piston being telescopic and comprising two, front and rear, piston parts axially movable relative to each other against the action of elastic means biasing them axially away from each other, the front piston part carrying the associated phase or neutral receptacle and the rear piston part being adapted to come into simple bear engagement with the associated stud.

4. A socket according to claim 1, wherein an elastic return means constantly urges each of said contact pistons toward its first position.

5. A socket according to claim 4, wherein each said elastic return means comprises a metal coil spring bearing on the back of the associated explosionproof safety chamber and against the associated contact piston through an insulating intermediate member for biasing its associated contact piston to its first position.

6. A socket according to claim 5, wherein said intermediate member defines a bush bearing on a central base of the associated contact piston and extends annularly around a corresponding rear receptacle of said contact piston.

7. A socket according to claim 6, wherein each said bush extends beyond its associated rear receptacle.

8. A socket according to claim 1, wherein each said phase or neutral receptacle includes an internal transverse shoulder at a distance from the back of the associated chamber adapted to limit the engagement of a cooperable plug pin.

9. A socket according to claim 2, wherein each said rear receptacle comprises an internal transverse shoulder at a distance from the back of the associated chamber adapted to limit the engagement of the cooperable socket pin.

10. A socket according to claim 1, further comprising detent means for releasably maintaining each said contact piston in its first position.

11. A socket according to claim 10, wherein said detent means comprises an elastic ring engagement in an annular groove in the outer periphery of each said contact piston, intermediate the ends of the contact piston, and a complementary annular groove in an internal wall of the associated explosionproof safety chamber for engagement with said elastic ring.

12. A socket according to claim 2, wherein each said receptacle is radially inwardly preloaded by means of a spring binding ring, the radial preload of the phase or neutral receptacles being greater in magnitude than that of the corresponding rear receptacles.

13. A socket according to claim 11, wherein said contact member comprises a socket pin projecting axially from the back of the associated explosionproof safety chamber, and the associated contact piston carries in the associated back compartment another, rear, receptacle cooperable with the associated socket pin, each of said receptacles being radially inwardly preloaded by means of a spring binding ring, the radial preload of each of the phase or neutral receptacles being greater in magnitude than the radial preload of the corresponding rear receptacle, the axial force due to the gripping of a plug pin by each of said phase or neutral receptacles due to the radial preload being greater than the axial force due to the gripping of said socket pin of the corresponding rear receptacle due to the radial preload of said rear receptacle and an axial force due to friction between said internal wall of each of said explosionproof safety chambers and said elastic ring of the associated contact piston.

14. A socket according to claim 10, wherein each of said receptacles is radially inwardly preloaded, the associated contact piston carries in the associated back compartment a rear receptacle, each of said receptacles being radially preloaded, the radial preload of each phase or neutral receptacle being greater in magnitude than the radial preload of the corresponding rear receptacle, an axial force opposing the engagement of a plug pin into the associated phase or neutral receptacle due to the radial preload difference being less than an axial force necessary to disengage the detent means of the associated contact piston.

15. A socket according to claim 4, further comprising detent means for releasably maintaining each said contact piston in its first position, each of said receptacles being radially inwardly preloaded by means of a spring binding ring, the radial preload of the phase or neutral receptacles being greater in magnitude than that of a corresponding rear receptacle of said contact piston, the axial force opposing the engagement of a plug pin into the phase or neutral receptacle due to the radial preload being less than the sum of the axial force required to overcome the action of the elastic return means for the associated contact piston and the axial force necessary to release said detent means of the associated contact piston.

16. A socket according to claim 4, further comprising elastic ring detent means adapted to retain each said contact piston in its first position, an axial force exerted by said associated elastic return means being greater than an axial force due to friction between the interior wall of the associated explosionproof safety chamber and its elastic ring.

17. A socket according to claim 2, wherein each of said receptacles is radially preloaded, and all of said receptacles have equal preloads.

18. A socket according to claim 1, further comprising a housing, a cover pivoted to said housing for closing said chambers, and a latch member having a first notch for maintaining said cover in a closed position and a second notch beyond the first notch for retaining a plug temporarily in an intermediate position during its extraction from the socket.

19. A socket according to claim 18, wherein an oblique engagement chamber precedes said second notch of said latch chamber.

20. A socket according to claim 1, wherein each of said chambers has an inlet opening to its front compartment, said inlet opening having a diameter corresponding to a diameter of a plug pin so that the associated front compartment is thus explosionproof.

* * * * *